US005897484A

United States Patent [19]

Ridderstråle et al.

[11] Patent Number: 5,897,484

[45] Date of Patent: Apr. 27, 1999

[54] CENTRIFUGAL SEPARATOR TO FREE A LIQUID FROM BATH LIGHTER PARTICLES AND HEAVIER PARTICLES

[75] Inventors: Rolf Ridderstråle, Stockholm; Klaus Stroucken, Rönninge, both of Sweden

[73] Assignee: Alfa Laval AB, Lund, Sweden

[21] Appl. No.: 08/930,706

[22] PCT Filed: Mar. 27, 1996

[86] PCT No.: PCT/SE96/00395

§ 371 Date: Oct. 16, 1997

§ 102(e) Date: Oct. 16, 1997

[87] PCT Pub. No.: WO96/33022

PCT Pub. Date: Oct. 24, 1996

[30] Foreign Application Priority Data

Apr. 18, 1995 [SE] Sweden ..... 9501392-6

[51] Int. Cl.[6] ..... B04B 1/08; B04B 7/14

[52] U.S. Cl. ..... 494/71

[58] Field of Search ..... 494/56, 67–73

[56] References Cited

U.S. PATENT DOCUMENTS

| | | | |
|---|---|---|---|
| 1,283,343 | 10/1918 | Snyder | 494/70 |
| 1,482,418 | 2/1924 | Unger | 494/70 |
| 2,478,992 | 8/1949 | Wheelwright, Jr. | 494/70 |
| 2,726,808 | 12/1955 | Fitzsimmons | 494/70 |
| 4,930,412 | 6/1990 | Stroucken | 494/70 |
| 5,676,631 | 10/1997 | Kunz et al. | 494/71 |

FOREIGN PATENT DOCUMENTS

| | | |
|---|---|---|
| 593452 | 8/1925 | France . |
| 19 666 | of 1904 | Sweden . |
| 21 885 | of 1904 | Sweden . |

*Primary Examiner*—Charles E. Cooley
*Attorney, Agent, or Firm*—Fish & Richardson P.C.

[57] ABSTRACT

In a centrifugal rotor having inlet channels (23) situated between a stack of axially separated conical separation discs (13) and the rotor end wall (10), towards which the separation discs turn their apex ends, there is formed a counter pressure chamber (22) in an area where the inlet channels (23) communicate with one end of several distribution channels (21) extending through the stack of separation discs. The counter pressure chamber (22) is free of entrainment members, so that liquid leaving the inlet channels (23) is allowed to rotate in the counter pressure chamber at a smaller angular speed than the rotor. Further, the counter pressure chamber (22), communicates with a radially outer portion of the rotor separation chamber (9) through a sludge passage (34), which opens in the separation chamber at a level radially outside the stack of separation discs. The outlet channels (27) for separated liquid extend towards the rotor axis (R) from an area of the separation chamber which is situated in the vicinity of said rotor end wall (10) at a level in the separation chamber radially outside the stack of separation discs (13).

13 Claims, 1 Drawing Sheet

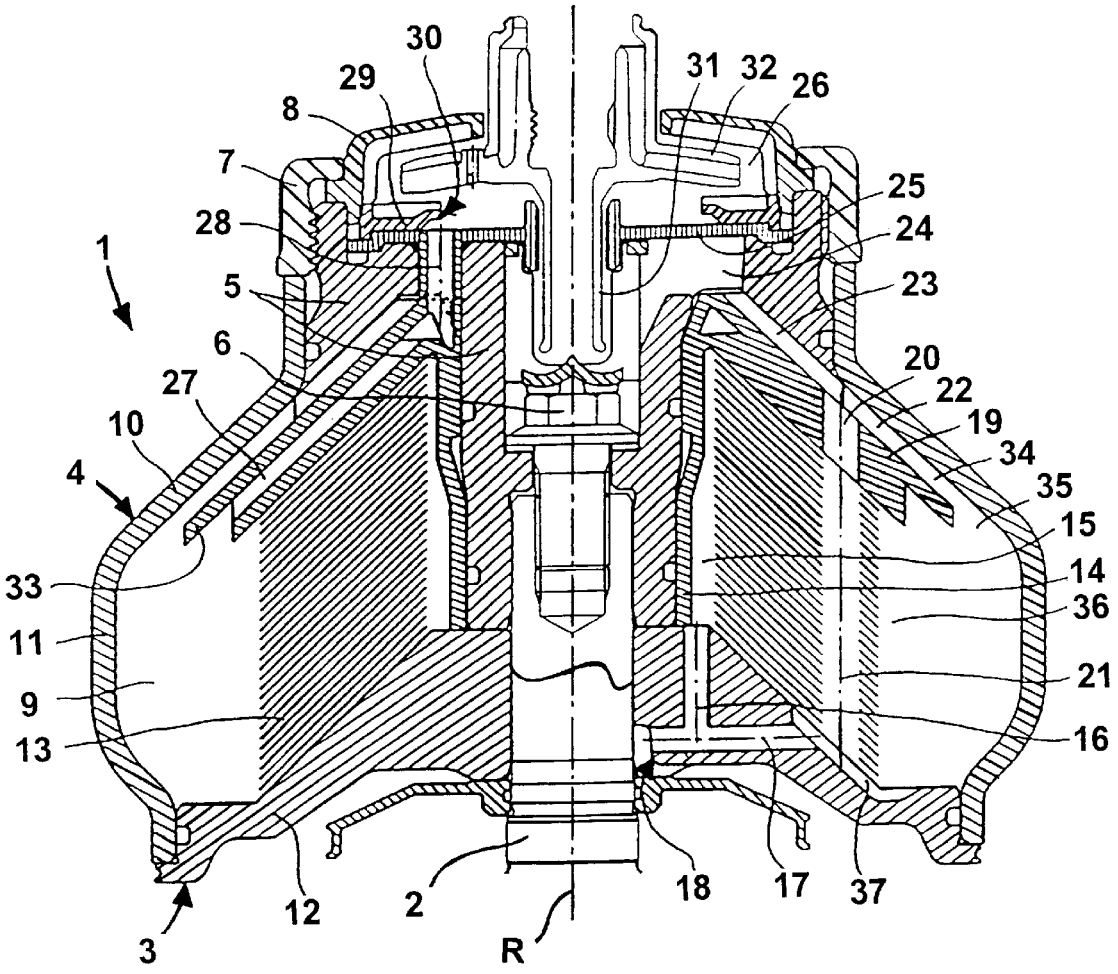
30
29
31
32
26
8
7
25
28
24
1
5
23
6
20
27
22
10
19
34
4
35
15
33
14
36
11
21
9
16
13
12
2
18
17
37
3
R

CENTRIFUGAL SEPARATOR TO FREE A LIQUID FROM BATH LIGHTER PARTICLES AND HEAVIER PARTICLES

FIELD OF THE INVENTION

The present invention concerns a centrifugal separator which is particularly designed for freeing a liquid, e.g. water, from both suspended light particles, e.g. oil drops, having a density smaller than that of the liquid, and suspended heavy particles, e.g. solids, having a density larger than that of the liquid.

BACKGROUND OF THE INVENTION

A starting point for the invention has been a centrifugal separator, which has a rotor for rotation around a central axis extending through the rotor and in which a rotor body, which comprises a first end wall and a second end wall arranged axially one on each side of a separation chamber surrounding the rotor axis, forms a central inlet for said liquid containing the suspended light and heavy particles, a central first outlet through said first end wall for liquid having been freed from light and heavy particles, and a central second outlet for a liquid light phase containing separated light particles, a stack of conical separation discs is so arranged in the separation chamber that the separation discs, which have base portions and apex portions and which are arranged with interspaces between themselves, are placed coaxially with the rotor and have their apex portions facing said first end wall, each one of several inlet channels, which are distributed around the central axis and which connect the central inlet of the rotor body with the separation chamber, has an inclination relative to the central axis in the same direction as a generatrix of each one of said conical separation discs, the separation discs have several series of aligned holes forming several parallel distribution channels through said stack, which communicate with the interspaces between the separation discs and at their ends closest to said first end wall communicate with said inlet channels, each one of a number of outlet channels, which are distributed around the rotor axis and intended for liquid having been freed from light and heavy particles, has a channel opening situated in the separation chamber in the vicinity of said first end wall at a level radially outside the stack of separation discs and extends from this channel opening towards the central axis of the rotor, and the rotor is substantially free of entrainment members in a flow space in the separation chamber situated radially outside and surrounding the stack of separation discs, so that liquid leaving the interspaces between the separation discs is allowed to rotate at an angular speed smaller than that of the rotor body while it flows towards said channel openings.

A centrifugal separator of this kind, known for instance from SE-19 666 and SE-21 885 (both granted in 1904), has certain advantages over other centrifugal separators. One advantage lies in the fact that liquid to be treated in the centrifugal separator is introduced into the rotor separation chamber at the rotor end wall, towards which the separation discs turn their apex portions. This makes possible an effective use, from a separation point of view, of said inlet channels which extend between the central inlet of the rotor and the so called distribution channels in the stack of separation discs. Thus, thanks to the inclination of these inlet channels in relation to the rotor axis, the pre-separation of liquid obtained in the inlet channels may be used to a maximum, i.e. the result of this pre-separation is not spoiled by an undesired cross flow of the part flows of liquids, which are obtained through the pre-separation, when the liquid is conducted further on into said distribution channels. Such cross flow would be obtained, however, if the liquid would be conducted into the distribution channels at the opposite end of the separation disc stack after having flowed through corresponding inlet channels having the same inclination relative to the central axis in this part of the rotor.

Another advantage of a centrifugal separator of the defined kind is that liquid being conducted into the separation chamber in the described manner can, advantageously, be introduced into the rotor at the rotor body end wall at which said inlet channels are situated. Thus, the liquid need not be conducted axially through the whole of the rotor before it enters the separation chamber, which today most often occurs in centrifugal rotors having frusto conical separation discs. This is advantageous particularly in connection with rotors having relatively small dimensions and having both of their respective end walls kept axially together by means of force absorbing members arranged centrally in the rotor.

SUMMARY OF THE INVENTION

The object of the present invention has been to improve a centrifugal separator of the just described kind in a way such that in connection with a separation operation in which the liquid contains a very small amount of suspended light particles, for instance 1 percent or less by volume, not only the separated liquid will be substantially free from the suspended light particles but also the liquid light phase, which contains the separated light particles, will be substantially free from said liquid.

According to the invention this object can be achieved by the features that said inlet channels open in a counter pressure chamber, which extends around the rotor axis and is delimited axially by chamber walls which are substantially free of rotational entraining members, so that liquid is allowed to rotate in the counter pressure chamber at an angular speed smaller than that of the rotor body, that the counter pressure chamber has a first portion, which communicates with said distribution channels, and a second portion which is situated radially outside said first portion and communicates with at least one sludge passage, and that the sludge passage opens in the separation chamber at a level radially outside the stack of separation discs.

By this invention it has proved possible to arrange the central outlet of the rotor for the liquid light phase at an extremely large radial distance from the central outlet of the rotor for the liquid having been freed from particles. Thus, the interphase layer, which during rotor operation is formed in the separation chamber between separated liquid and said light phase, may be maintained relatively close to the radially outer edges of the separation discs. The result of this will be that the light phase which has a relatively small volume and flows slowly radially inwardly in the interspaces beween the separation discs is given very good time to be freed from said liquid.

Simultaneously, it is effectively avoided that the suspended light particles, which accompany the supplied liquid on its way through said inlet channels, enter the separation chamber through said sludge passages and as a consequence thereof may run the risk of flowing further to and into the outlet channels for separated liquid. This is obtained in part because a counter pressure, or resistance to liquid flow radially, is created in the counter pressure chamber during the rotor operation, which forces the main part of the incoming liquid to flow into the separation chamber through said distribution channels, and in part because light particles, which after all accompany parts of the incoming liquid from the counter pressure chamber into said sludge passage, are given an opportunity to be separated from the liquid and flow back to the counter pressure chamber thanks to the fact that the sludge passage extends a distance radially outside the stack of separation discs. From the counter pressure chamber the returning light particles then may accompany the major part of the liquid into said distribution channels.

An even larger security against having light particles entering the separation chamber through said sludge passage can be obtained if the latter opens in the separation chamber at a level radially outside the openings of the outlet channels in the separation chamber.

Preferably, the sludge passage may constitute a continuation radially outwardly of the counter pressure chamber and, like this, be substantially free of rotational entraining members. Thereby, an even larger counter pressure may be obtained in the counter pressure chamber for preventing incoming liquid from passing into the separation chamber through the sludge passage.

The main purpose of said sludge passage is to form a separate flow path into the separation chamber for solids having been separated from the incoming liquid already in the inlet channels. For this reason these solids will not be conducted into the distribution channels in the stack of separation discs, where they otherwise have a tendency of clogging the interspaces between the separation discs. Due to the fact that the sludge passage is so long that it extends radially outside the stack of separation discs, a minimum of incoming liquid will flow into the separation chamber this way. Primarily just separated solids will thus leave the sludge passage and enter directly into the radially outermost part of the separation chamber.

In a preferred embodiment of the invention a conical partition is arranged between said first end wall and the stack of separation discs, the counter pressure chamber being formed by and between the conical partition and said first end wall. In an embodiment of this kind the conical partition preferably has through openings through which the inlet channels communicate with the distribution channels. The conical partition preferably extends also radially outside the stack of separation discs and, thereby, may delimit even said sludge passage between itself and said first end wall.

The outlet channels for separated liquid, which as was stated have their inlet openings situated at a level radially outside the stack of separation discs, may be formed by tubular members, but preferably they are constituted by recesses or bores through said conical partition. If desired, the conical partition may be composed of two conical discs which are arranged coaxially and at some distance from each other, said outlet channels being delimited between the discs and a plurality of wings arranged therebetween and distributed around the rotor axis.

Preferably, the outlet channels have their inlet openings situated in an annular area situated between the stack of separation discs and the area of the sludge passage opening in the separation chamber. Thereby, the risk is avoided that heavy particles having been separated from the incoming liquid in the inlet channels and in the sludge passage will cross on its way into the separation chamber a flow of separated liquid, which in the separation chamber is on its way from the interspaces between the separation discs to said outlet channel openings.

Since the centrifugal separator according to the invention is intended in the first place for separation of relatively small amounts of suspended light and heavy particles from a liquid, the outcoming amount of separated liquid being relatively large in relation to the amount of separated liquid light phase, the rotor preferably has both its central inlet and its central first outlet, intended for separated liquid, situated at said first rotor end wall, whereas the central second outlet of the rotor, intended for separated light phase, is situated at said second rotor end wall. The latter end wall, thereby, is the one best suited for connection to a drive shaft for rotation of the rotor.

BRIEF DESCRIPTION OF THE DRAWINGS

The invention will be described in the following with reference to the accompanying drawing.

DETAILED DESCRIPTION

In the drawing there is shown a rotor 1 supported on the top of a rotable drive shaft 2. The rotor has a central axis R, which coincides with the geometrical axis of the drive shaft 2. A motor (not shown) is arranged for rotation of the drive shaft 2 and, thereby, the rotor 1 around the central axis R.

The rotor 1 further has a rotor body comprising a lower part 3, an upper part 4 and a center part 5. The lower rotor body part 3 surrounds the drive shaft 2 and is firmly connected therewith. The center part 5 is connected by means of a bolt 6 with the drive shaft 2 and rests axially against a center portion of the lower rotor part 3. Onto the upper portion of the center part 5 there is threaded a ring 7, which by means of a radially inwardly directed flange maintains an annular cover 8 axially against the center part 5. The ring 7 is also arranged to press the upper rotor body part 4 axially against a radially outer portion of the lower rotor body part 3. In this way the rotor body parts 3 and 4 are kept axially pressed together and firmly connected with the drive shaft 2.

The rotor body delimits a separation chamber 9 surrounding the axis R. The upper rotor body part 4 forms a first end wall 10 and a surrounding wall 11. The lower rotor body part 3 forms a second end wall 12.

In the separation chamber 9 there is mounted for rotation with the rotor body a stack of frusto conical separation discs 13 arranged at small axial distances from each other. Spacing members (not shown) are arranged between adjacent separation discs 13 and serve as entrainment members in the spaces between the separation discs. The stack of separation discs 13, which are arranged coaxially with the axis R and have their apex portions facing said first or upper end wall 10 of the separation chamber, rests on the lower rotor body part 3.

In the area of the separation chamber 9 the center part 5 is surrounded by a sleeve 14 situated radially inside the stack of separation discs 13. The separation discs 13 have radially outer edges and radially inner edges, and between the latter and the sleeve 14 a flow space 15 is defined.

Extending axially through the lower rotor body part 3 there is a channel 16 which at its upper end communicates with the flow space 15 and at its lower end communicates with a radially extending channel 17. The channel 17 communicates at its radially outer end with the lower part of the separation chamber 9 and at its radially inner end with a central outlet of the rotor in the form of an overflow outlet 18. Several channels 16 and 17 may be present, distributed around the axis R.

At its upper end the sleeve 14 is connected with a frusto conical disc forming a partition 19 within the rotor body. The partition 19 situated axially between the stack of separation discs and the upper end wall 10 of the rotor has several through openings 20 distributed around the axis R and situated axially aligned with corresponding through openings in the separation discs 13. The openings through the separation discs form several parallel so called distribution channels 21, which communicate with the interspaces between the separation discs 13 and, at their ends closest to the end wall 10, with an annular space 22 situated between this end wall 10 and the partition 19. As can be seen from the drawing, the distribution channels 21 are situated substantially closer to the outer edges of the separation discs 13 than to the inner edges thereof.

The space 22 extends without interruption around the rotor axis R, and the end wall 10 as well as the partition 19 are free of protuberances or other rotational entraining members in the area of the space 22. In order to be kept spaced from the end wall 10 during rotation of the rotor spacing members (not shown) may be arranged between the radially outermost part of the partition 19 and the end wall 10.

On its upper side the partition 19 carries along its radially innermost portion several radially extending wings, which together with the partition 19 and an upper portion of the center part 5 delimit several inlet channels 23. Each one of these inlet channels 23, which have an inclination relative to the axis R corresponding to the inclination of the generatrix of each one of the separation discs 13, starts from a central receiving chamber 24 in the rotor and opens into the annular space 22. As can be seen said wings and, thus, the inlet channels 23 extend radially outwardly to a level through the openings 20 in the partition 19.

The central receiving chamber 24 is delimited by the upper portions of the central part 5 and the conical partition 19, respectively, and an annular further partition 25. Above the partition 25 there is delimited between this and the cover 8 an outlet chamber 26.

Extending through the frusto conical partition 19 several outlet channels 27 extend from the separation chamber 9 at a level radially outside the stack of separation discs to a corresponding number of short axially extending pipes 28, which are connected with the central portion of the partition 19. The pipes 28 extend through the center part 5 and the annular partition 25 and open into the outlet chamber 26. Axially above the openings of the pipes 28 into the outlet chamber 26 there is arranged in the latter an annular so called gravity disc 29 forming a central overflow outlet 30 from the separation chamber to the outlet chamber 26.

A stationary inlet pipe 31 opening in the receiving chamber 24 extends centrally into the rotor through the cover 8 and the annular partition 25.

A so called paring disc 32, also stationary, is connected with the inlet pipe 31 and extends into the outlet chamber 26 to a level radially outside the overflow outlet 30 formed by the gravity disc 29.

In the separation chamber 9 a radially outer portion 33 of the frusto conical partition 19 extends to a level radially outside the openings of the outlet channels 27 in the separation chamber. This radially outer portion 33 of the partition 19, as well as the portion of the same partition situated radially between the openings of the outlet channels 27 and the radially outer edges of the separation discs 13, have substantially smooth surfaces facing the separation chamber 9. These surfaces are thus free of entrainment members.

Between the end wall 10 of the rotor body and the radially outer portion 33 of the partition 19 there is formed a so called sludge passage 34 which constitutes a prolongation radially outwardly of the space 22 and which is inclined relative to the rotor axis R in the same way as the inlet channels 23. Radially outside the sludge passage 34 there is an area 35 of the separation chamber 9 through which particles may move from the sludge passage 34 to the radially outermost part of the separation chamber.

The stack of separation discs 13 is surrounded by a space 36, which constitutes a part of the separation chamber 9 and through which liquid may flow from the interspaces between the separation discs 13 to and into the inlet openings of the outlet channels 27 in the partition 19.

In the lower part of the separation chamber 9 the lower rotor body part 3 has at least one narrow radial groove 37, which forms a passage connecting the separation chamber radially outside the stack of separation discs 13 with a channel 17. This passage is intended for automatic drainage of the separation chamber when the rotor has been stopped after finished separation.

The centrifugal separator shown in the drawing operates in the following manner.

After the rotor has been brought into rotation around the axis R a liquid is conducted into the receiving chamber 24 through the inlet pipe 31, in which liquid there are suspended particles which are lighter than the liquid as well as particles which are heavier than the liquid.

From the receiving chamber 24 the liquid flows further on through the inlet channels 23, in which it is entrained totally in the rotation of the rotor. Owing to the rotation of the liquid and the inclination of the inlet channels 23 relative to the axis R an effective pre-separation of the suspended particles is obtained while the liquid flows through the inlet channels. Thus, suspended light particles will within the inlet channels 23 approach and be concentrated in a layer closest to the partition 19, whereas suspended heavy particles will approach and be concentrated in a layer closest to the adjacent surfaces of the center part 5.

When the liquid reaches the openings 20 in the partition 19, where the inlet channels 23 open into the space 22, part of the liquid flows further on through the openings 20 and into the distribution channels 21. Another part of the liquid instead starts to rotate in the space 22 around the axis R at a speed lower than that of the rotor body. This depends on the fact that the space 22 is free of entrainment members.

The reduced rotational speed of part of the liquid in the space 22 causes a counter pressure to come up for radially outwardly directed liquid flow through the space 22. Thus, the space 22 will form a kind of counter pressure chamber. A consequence of this is that the resistance for liquid to flow in through the openings 20 and further on into the distribution channels 21 will be smaller than the resistance for the liquid to flow into the separation chamber 9 through the whole space 22 and the sludge passage 34.

However, a large part of the already pre-separated heavy particles which are present close to the end wall 10 in the space 22 will move further on along this end wall 10 through both the counterpressure chamber 22 and the sludge passage 34 and, then, to move through the area 35 out to the radially outermost part of the separation chamber 9.

Even a small part of liquid containing suspended light particles will move a distance radially outwardly in the counterpressure chamber 22 and in the sludge passage 34. However, during this flow of liquid the suspended light particles will gradually be separated from the liquid in the sludge passage due to the centrifugal force and be collected in a layer closest to the partition 19. In this layer as a consequence of their small specific weight they will move radially inwardly and gradually reach the openings 20 and be entrained by the liquid flowing through these openings into the distribution channels 21.

Liquid having entered the distribution channels 21 flows further on into the interspaces between the separation discs 13. Between the separation discs the suspended light particles are separated from the liquid and move towards the rotor axis R. At a radial level somewhere in the interspace between the separation discs 13 there is formed during the rotor operation an interface layer between a so called light phase, which consists mainly of separated light particles, and liquid having been freed from such light particles. The light phase may, if the light particles are constituted by oil or these oil particles or drops coalesce at a certain concentration, be constituted by a continuous phase of a liquid having a smaller density than the liquid having been freed from light particles. Alternatively, the light phase may be constituted by a concentrated suspension of light particles in liquid, e.g. fat globules, which are still suspended in a small amount of the original carrying liquid. In both cases the light phase thanks to the centrifugal force is gradually freed from residuals of the original carrying liquid as the light phase approaches the flow space 15 radially inside the separation discs 13. The light phase contains in the flow space 15 a minimum of the original carrying liquid and flows from here out of the rotor through the channels 16 and 17 and the overflow outlet 18.

Liquid having been freed from suspended light particles leaves the interspaces between the separation discs 13 radially outwardly and flows through the area 36 of separation chamber 9 to and into the outlet channels 27. As long as the liquid is present between the separation discs 13 it rotates around the axis R of the rotor at substantially the same angular speed as the rotor, but in the area 36 lacking entirely entrainment members the liquid will rotate at a smaller angular speed than the rotor. Thus, the liquid in this area will move both axially towards the outlet channels 27 and around the stack of separation discs. The area in which liquid flows relative to the rotor in the circumferential direction of the latter after it has left the interspaces between the separation discs 13 comprises both the space around the stack of separation discs itself—along the whole of the axial extension of the stack—and the annular space which is situated immediately outside the openings of the outlets 27 and is limited by the radially outermost portion 33 of the partition 19.

It should be noticed, thus, that the area 35 of the separation chamber 9, through which pre-separated heavy particles move from the sludge passage 34 to the radially outermost part of the separation chamber 9, is situated totally outside the just mentioned area, in which liquid flows from the interspaces between the separation discs to and into the outlet channels 27. Thereby, there is no risk for preseparated heavy particles to be entrained by the liquid into the outlet channels 27.

As a result of the fact that liquid is not entrained totally in the rotor rotation in the area 36, which surrounds the separation discs, the liquid in this area will create a flow resistance to liquid being on its way in a direction away from the rotor axis towards the outlet channels 27. This means that the liquid column, which to a large part consists of separated light phase and which is present between the area 36 and the overflow outlet 18, may be comparatively high, i.e. may have a comparatively large radial extension. Even if the liquid in the area 36 had rotated at the same speed as the rotor, said liquid column would by necessity have been higher, i.e. have had a larger radial extension, than the liquid column consisting mainly of separated liquid and being situated between the area 36 and the overflow outlet 30 of the gravity disc 29. However, thanks to the circumstance that the area 36 is lacking entrainment members for the liquid, the difference in height between the two liquid columns can be made extremely large. This makes possible a maximum cleanliness of the finally separated light phase, which in this way may be given very good time to be freed from residuals of the original carrying liquid.

As mentioned earlier, the surfaces of the partition 19 facing the separation chamber are smooth, so that they will not to any substantial degree be able to entrain liquid in the area 36. The groove 37 in the lower rotor body part 3 is so narrow that it will not influence the liquid flow in the area 36.

What is claimed is:

1. A centrifugal separator for freeing a liquid from suspended light particles, which have a density lower than that of the liquid, and suspended heavy particles, which have a density higher than that of the liquid, said centrifugal separator having a rotor (1), which is arranged for rotation around a central axis (R) extending through the rotor and comprising a rotor body (3–5), having a first end wall (10) and a second end wall (12) arranged one on each side of a separation chamber (9) surrounding the rotor axis (R), a central inlet (24) for said liquid containing the suspended light and heavy particles, a central first outlet (26) through said first end wall for liquid having been freed from light and heavy particles, and a central second outlet (18) for a liquid light phase containing separated light particles, a stack of conical separation discs (13) arranged in the separation chamber (9) so that the separation discs, having base portions and apex portions and being arranged with interspaces between said discs, are placed coaxially with the rotor and turn said apex portions towards said first end wall (10), a plurality of inlet channels (23), said channels being distributed around the central axis and connecting the central inlet (24) of the rotor body with the separation chamber (9), and having an inclination relative to the central axis (R) in the same direction as a generatrix of each one of said conical separation discs (13), the separation discs (13) having several series of aligned holes forming several parallel distribution channels (21) through said stack, said distribution channels communicating with the interspaces between the separation discs (13) and at the ends of said distribution channels closest to said first end wall (10) communicating with said inlet channels (23), a plurality of outlet channels (27), said outlet channels being distributed around the rotor axis (R) and intended for liquid having been freed from light and heavy particles, and having channel openings situated in the separation chamber (9) in the vicinity of said first end wall (10) at a level radially outside the stack of separation discs and extending from said channel openings towards the central axis (R), and the rotor being substantially free of entrainment members in a flow area (36) in the separation chamber (9) situated radially outside and surrounding the stack of separation discs (13), so that liquid leaving the interspaces between the separation discs is allowed to rotate at a smaller angular speed than the rotor body while said liquid flows towards said channel openings, wherein said inlet channels (23) open in a counter pressure chamber (22), which extends around the rotor axis (R) and is delimited axially by chamber walls which are substantially free of rotational entraining members, so that liquid is allowed to rotate in the counter pressure chamber (22) at a smaller angular velocity than the rotor body, further wherein the counter pressure chamber (22) has a first portion, which communicates with said distribution channels (21), and a second portion, which is situated radially outside said first portion and which communicates with at least one sludge passage (34), and further wherein the at least one sludge passage (34) opens in the separation chamber (9) at a level radially outside the stack of separation discs (13).

2. The centrifugal separator according to claim 1, in which the at least one sludge passage (34) opens in the separation chamber (9) at a level radially outside said channel openings.

3. The centrifugal separator according to claim 1, in which the at least one sludge passage (34) comprises a continuation radially outwardly of said counter pressure chamber (22) and is substantially free of rotational entraining members.

4. The centrifugal separator according to claim 1, in which the rotor is substantially free of entraining members in areas of the separation chamber which are situated axially aligned with said flow area (36) radially outside and surrounding the stack of separation discs (13).

5. The centrifugal separator according to claim 1, in which a conical partition (19) is arranged between said first end wall (10) and the stack of separation discs (13), the counter pressure chamber (22) being formed by and between the conical partition (19) and said first end wall (10).

6. The centrifugal separator according to claim 5, in which the conical partition (19) has through openings (20) through which the inlet channels (23) communicate with the distribution channels (21).

7. The centrifugal separator according to claim 5, in which the conical partition (19) extends radially outside the stack of separation discs (13) and is substantially smooth on a surface thereof, said surface facing axially towards said flow area (36) radially outside and surrounding the stack of separation discs (13).

8. The centrifugal separator according to claim 7, in which said conical partition (19) delimits said outlet channels (27) and said outlet channel openings in the separation chamber (9).

9. The centrifugal separator according to claim 5, in which a portion (33) of the conical partition (19) extends a distance radially outside said channel openings between said channel openings and said first end wall (10).

10. The centrifugal separator according to claim 9, in which said portion (33) of the conical partition (19) has a substantially smooth surface facing the separation chamber (9) in an area radially outside said channel openings.

11. The centrifugal separator according to claim 1, in which said distribution channels (21) extend through the stack of separation discs (13) at a distance from the radially outer edges of the separation discs, said distance being smaller than the distance between the distribution channels (21) and the radially inner edges of the separation discs.

12. The centrifugal separator according to claim 1, in which the central inlet (24) of the rotor for liquid to be treated extends through said first end wall (10).

13. The centrifugal separator according to claim 1, in which said second central outlet (18) of the rotor body, intended for said liquid light phase, extends through said second end wall (12).

* * * * *

UNITED STATES PATENT AND TRADEMARK OFFICE

CERTIFICATE OF CORRECTION

PATENT NO. : 5,897,484

DATED : Apr. 27, 1999

INVENTOR(S) : Ridderstråle et al.

It is certified that error appears in the above-identified patent and that said Letters Patent is hereby corrected as shown below:

On the cover page, section 54, change "CENTRIFUGAL SEPARATOR TO FREE A LIQUID FROM BATH LIGHTER PARTICLES AND HEAVIER PARTICLES" to --CENTRIFUGAL SEPARATOR TO FREE A LIQUID FROM BOTH LIGHTER PARTICLES AND HEAVIER PARTICLES--.

Col. 1, line 2, change "CENTRIFUGAL SEPARATOR TO FREE A LIQUID FROM BATH LIGHTER PARTICLES AND HEAVIER PARTICLES" to --CENTRIFUGAL SEPARATOR TO FREE A LIQUID FROM BOTH LIGHTER PARTICLES AND HEAVIER PARTICLES--.

Signed and Sealed this

Nineteenth Day of October, 1999

*Attest:*

*Attesting Officer*

Q. TODD DICKINSON

*Acting Commissioner of Patents and Trademarks*